United States Patent [19]

Shin

[11] Patent Number: 4,498,251

[45] Date of Patent: Feb. 12, 1985

[54] SHOE DESIGN

[75] Inventor: Yoon K. Shin, Pusan, Rep. of Korea

[73] Assignee: Mercury International Trading Corp., Mansfield, Mass.

[21] Appl. No.: 464,204

[22] Filed: Feb. 7, 1983

[51] Int. Cl.[3] ..... A43B 13/14; A43B 13/18; A43B 13/00

[52] U.S. Cl. ..... 36/30 R; 36/32 R; 36/59 C

[58] Field of Search ..... 36/25 R, 30 R, 30 A, 36/32 R, 59 C, 102, 103

[56] References Cited

U.S. PATENT DOCUMENTS

| | | | |
|---|---|---|---|
| 2,162,912 | 6/1939 | Craver | 36/59 C |
| 2,201,300 | 5/1940 | Prue | 36/25 R |
| 2,981,011 | 4/1961 | Lombardo | 36/59 C |
| 3,018,571 | 1/1962 | Doherty | 36/59 C |
| 4,309,832 | 1/1982 | Hunt | 36/32 R |
| 4,377,041 | 3/1983 | Alchermes | 36/30 R |
| 4,402,146 | 9/1983 | Parracho et al. | 36/32 R |

FOREIGN PATENT DOCUMENTS

| | | | |
|---|---|---|---|
| 2043659 | 3/1972 | Fed. Rep. of Germany | 36/32 R |
| 4296 | of 1896 | United Kingdom | 36/59 C |

*Primary Examiner*—Werner H. Schroeder
*Assistant Examiner*—Steven N. Meyers
*Attorney, Agent, or Firm*—Wolf, Greenfield & Sacks

[57] ABSTRACT

A running shoe having a sole structure that includes an outsole extending from the toe to the heel and having a thickened section extending the full width of the sole structure and positioned to underlie the ball of the foot. The thickened section is appreciably thicker than the portions of the outsole that underlie the remainder of the foot. A plurality of parallel slots are cut in the thicker section across the full width of the outsole and extend from the bottom surface or tread, upwardly to just short of the top surface of the outsole to form hinges which allow it to readily flex. The slots may be partially bridged by struts which do not interfere with the hinge action at each of the slots but which provide added strength to the outsole at that region.

19 Claims, 9 Drawing Figures

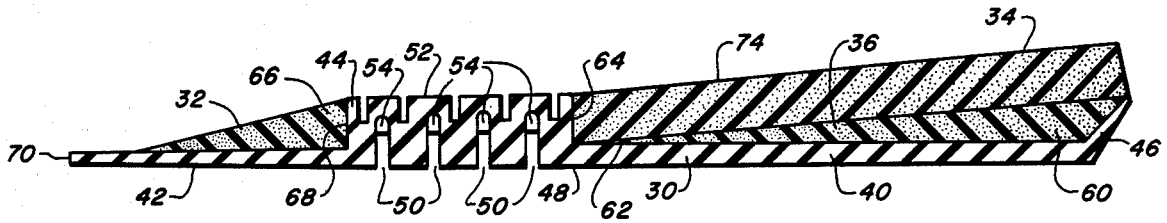
FIG. 3
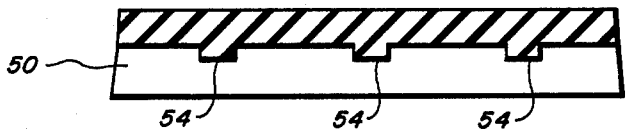
FIG. 4
FIG. 5
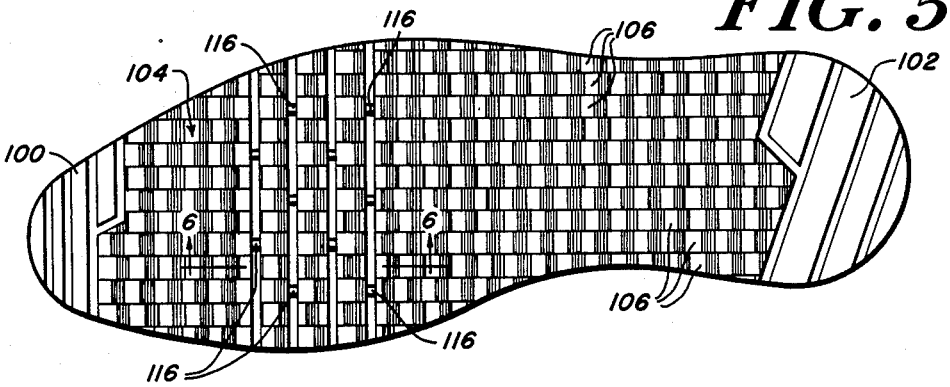
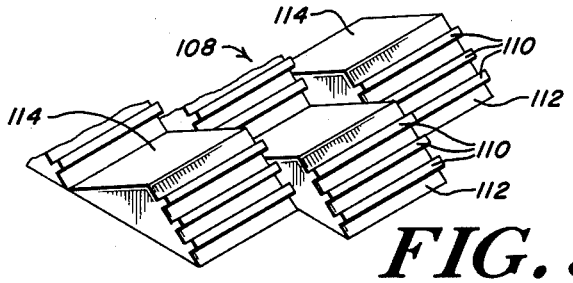
FIG. 5A
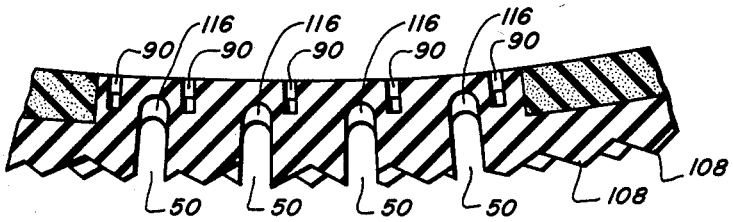
FIG. 6

SHOE DESIGN

BACKGROUND OF THE INVENTION

1. Field of the Invention

The present invention relates to shoes such as running shoes and sport shoes and more particularly to an outsole which provides improved flexibility and added protection to the ball of the foot.

2. Brief Background of the Invention

With the advent of the intense interest in running, shoe manufacturers have endeavored to design shoes which are comfortable, safe, and long-wearing. Unfortunately, some have found that in order to accomplish one of these goals, another is sacrificed.

Initially, running shoe manufacturers concentrated their efforts on the heel portion of the shoe. Their goal was to reduce the amount of force transmitted to the foot upon heel strike. This was done by adding foam wedges of various sizes and shapes directly beneath the heel portion of the shoe. As a result, the heel portion of the running shoe has become elevated, which causes an exaggerated heel-to-toe foot roll movement. Manufacturers have determined that the exaggerated heel-to-toe movement causes the ball of the foot to be subjected to a torque-like force in addition to the normal downward striking force upon impact with the running surface. These forces act in such a way that the ball of the foot requires a shoe which has sufficient cushioning in order to absorb the striking force, and yet is flexible enough to handle the torque movement of the foot. Unfortunately, as cushioning material is added beneath the ball of the foot, the flexibility of the shoe is reduced. Conversely, if the shoe is made more flexible, very often is is accomplished by reducing the amount of cushioning beneath the ball of the foot.

To add flexibility to the shoe while maintaining an adequate amount of cushioning, some manufacturers have made the upper more flexible, and others have lasted the shoe so that the toe box portion is curved upward. These designs often have not been satisfactory in that they have not provided the comfort and long-wearing characteristics desired by the average runner.

In addition, it is quite common for the cushioning material beneath the ball of the foot to become flattened and deformed. This results not only from the striking force but also from the significant torque forces during foot roll. Consequently, the breakdown of the cushioning portion beneath the ball of the foot sometimes requires the shoe to be discarded even though other parts of the shoe are not worn.

The present invention combines flexibility with a significant amount of padding beneath the ball of the foot. This is accomplished in such a way as to minimize the breakdown of the material beneath the ball of the foot and results in a long-wearing shoe.

SUMMARY OF THE INVENTION

The present invention relates to a running shoe having a sole structure that has a thickened section beneath the ball of the foot. The sole structure includes an outsole extending from the toe to the heel and having a thickened section extending the full width of the sole and positioned to underlie the ball of the foot. The thickened section is appreciably thicker than the portions of the outsole to underlie the ramainder of the foot. A plurality of parallel slots are cut in the thicker section across the full width of the outsole in order to form hinge-like sections which allow the ball of the foot to flex. The slots may be partially bridged by struts which do not interfere with the hinge action but which provide added strength to the thickened portion of the outsole at the hinges.

This combination provides the necessary flex in the toe box region, provides the necessary padding under the ball of the foot to protect the foot upon impact with the ground, and is long-wearing since the outsole material is generally longer lasting than the soft cushioning material used in other shoes.

BRIEF DESCRIPTION OF THE DRAWINGS

FIGS. 3 and 4 are cross-sectioned views of the sole structure taken along the section lines 3—3 and 4—4 in FIG. 2, respectively;

FIG. 5 is a bottom view of the outsole of a second embodiment of this invention;

FIG. 5A is a perspective view of a few teeth of the tread of the outsole of FIG. 5; and FIG. 6 is a cross-sectioned view of the outsole taken along the section lines 6—6 of FIG. 5.

DETAILED DESCRIPTION OF THE INVENTION

Figure 1:
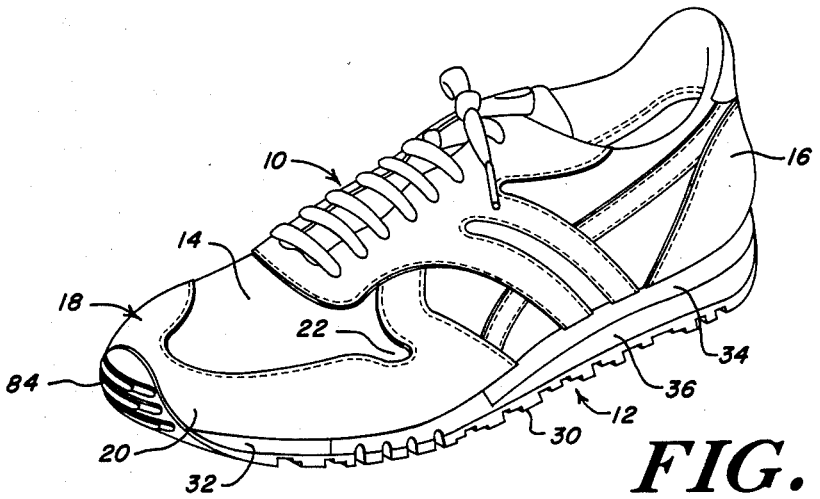
FIG. 1 is a perspective view of one embodiment of a running shoe embodying the new sole structure of the present invention.

The running shoe 10, shown in FIGS. 1 to 4, includes an upper 10 and sole 12 which may be secured together by any of the well-known lasting techniques used in the manufacture of running shoes. The upper 10 is preferably made of a lightweight, breathable material 14 which carries a heel counter 16 made of a firm material to center and stabilize the heel of the foot in the shoe. The upper also includes a toe box 18 that includes a firm toe guard 20 made of leather or other heavier material and is shown to include a notch 22 at the flexing line in the shoe forepart so as to contribute more flexibility in the ball area.

Figure 2A:
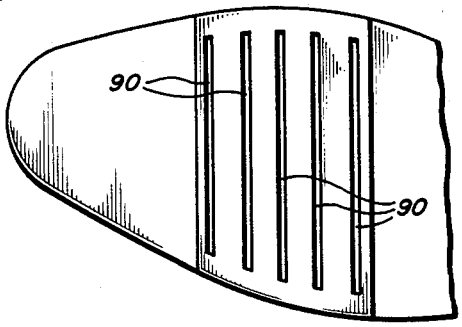
FIG. 2A is a fragmentary top view of the outsole at the ball section.
Figure 3A:
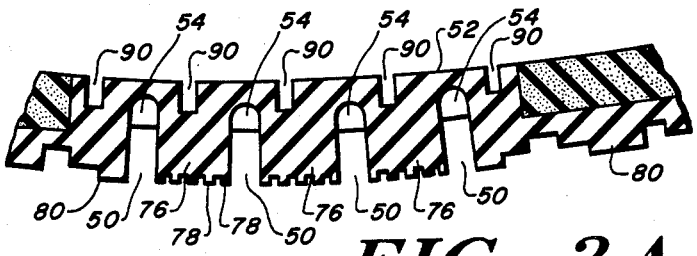
FIG. 3A is an enlarged fragmentary cross-sectioned view taken along section lines 3A—3A in FIG. 2.

The sole as shown in FIG. 3 is a multilayered structure which incorporates the particular improvements of the present invention. The several layers comprise the outsole 30 and a midsole which in turn includes sections 32 and 34 and wedge 36. The several parts of the sole are described in greater detail below, particularly with reference to FIGS. 2A, 3, 3A and 4.

Outsole 30, made of solid rubber or other wear-resistant material, is molded as a unitary structure and includes a rear or heel section 40, front or toe section 42, and ball section 44. Ball section 44 accounts for approximately $\frac{1}{4}$ to 1/5 of the total length of the outsole 30. The heel and toe sections 40 and 42 are of generally uniform thickness (typically $\frac{3}{8}$ (5 mm) inch) while ball section 44, also of uniform thickness, is several times as thick (typically 9/16 (15 mm) inch) as the heel and toe sections. The rear end of heel section 40 is shown turned upwardly at 46 to increase the life of the shoe by protecting the wedge 36 and insole section 34.

Figure 2:
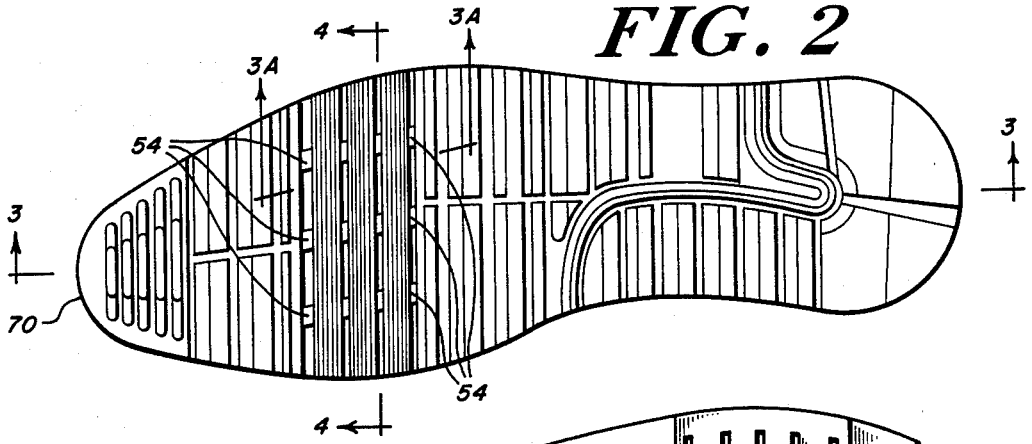
FIG. 2 is a bottom view of the outsole of the running shoe shown in FIG. 1.

The lower surface 48 of outsole 40 may be provided with a variety of different tread patterns, two of which are shown in FIGS. 2 and 5. The tread pattern shown in FIG. 2 includes a number of heavy, generally rectangular bars 50 which extend uniformally across the surface 48 to provide maximum traction while reducing friction and rejecting dirt and mud.

In FIG. 3 four parallel transverse slots 50 are shown which extend across the full width of the outsole in the ball section 44. Each of the slots 50 extends to the lower surface 48 of the outsole and they extend upwardly so as to terminate just short of the upper surface 52 of the section 44. The thin sections of the rubber outsole material above each slot 50 define hinge lines for the outsole so as to allow it to flex readily at the ball area. The thickness of the material above each of the slots is equal to or less than the thickness of the outsole 30 at the sections 40 and 42 so that the outsole is at least as flexible at the ball area as in the other sections of the sole, even though the ball section 44 far exceeds the thickness of the heel and toe sections 40 and 42.

As shown in FIGS. 2, 3, 3A, and 4, a number of struts 54 bridge the upper part of each slot 50 so as to provide increased strength for the outsole. While the struts 54 provide increased strength of the material so as to prevent it from splitting above the slots, the struts 54 are nevertheless sufficiently flexible so as not to appreciably interfere with the bending or flexing at the ball area along the hinge lines at the upper ends of the slots 50.

While outsole 30 is made of a solid rubber material having great resistance to wear, the wedge 36 and the midsole sections 32 and 34 are made of a foam material which is very resilient and which is designed to maintain this resilience for the life of the shoe. Wedge 36, which covers the heel portion 40 of the outsole at its rear end 60, is approximately equal in thickness to the difference between the thicknesses of the heel section 40 and the ball section 44 of the outsole. The wedge tapers uniformally to a sharp edge at its forward end 62 adjacent the rear wall 64 of the ball portion 44. The wedge may typically provide a forward slope for the sole platform of approximately 7°.

The midsole sections 32 and 34, which may be made of the same or a different foam material than the wedge 36 and whose density may be essentially the same as the wedge 36, tapers in a forward direction at the toe section 32 so that its thickness at the rear portion 66 is equal in height to the front wall 68 of the ball section 44 of the outsole. The toe section 32 of the midsole tapers to a point approximately $\frac{3}{4}$ inch from the front edge 70 of the outsole. Heel section 34 of the midsole is of substantially uniform thickness throughout, and its thickness is essentially equal to the height of the rear wall 64 of the ball section 44 of the outsole. Consequently, when the midsole sections 32 and 34 are cemented together, a smooth upper platform 74 is provided from the rear or heel portion of the sole structure to the toe tip 70. That is, the upper surfaces of the midsole sections 32 and 34 merge smoothly into the surface 52 of the ball section 44 of the outsole, and the front edge of the midsole toe section 32 merges smoothly into the upper surface of the toe section 42 of the outsole.

As shown in FIG. 3A, the slots 50, which traverse the ball section 44 of the outsole, define three major bar treads 76 that extend across the ball of the sole structure. These bars are in turn provided with several small ridges 78 on their lower surfaces to maximize the traction afforded by the bars. The ridges 78, because they are relatively narrow in cross-section measured from front to rear, are quite flexible so as to provide an added cushioning effect at the ball area to reduce shock upon impact. This is particularly desirable because of the absence of a foam insole at the ball area. The bars 80, which are provided at the heel and toe sections 40 and 42 of the outsole, do not include the ribs 78, as those areas are provided with the cushion midsole. The very end of the toe section 42 adjacent edge 70 is provided with transverse ribs 84 which are of very limited height so as to reduce friction in that area.

To reduce the weight of the sole structure, additional slots 90 are formed in the ball section 44 of the outsole and are positioned between or out of alignment with the slots 50 that extend upwardly from the lower surface. The slots 90 vertically overlap the upper ends of the slots 50 and, as shown in FIG. 2A, terminate short of the side edges of the outsole so as not to weaken the ball section 44.

The embodiment of the invention shown in FIGS. 5 and 6 differs from that shown in FIGS. 2 to 4, principally in the configuration of the tread of the outsole. With the exception of the front and rear portions 100 and 102 of the tread 104, the tread is uniform throughout the bottom surface of the outsole and is composed of a number of longitudinally extending rows 106 which in section define a saw-tooth 108 configuration as shown in FIGS. 5 and 6. The rows 106 are relatively narrow, preferably approximately 1 inch or less in width, and each tooth 108 defines an isosceles triangle. The teeth 108 in adjacent rows 106 are shown in FIGS. 5, 5A and 6 to be 180 degrees out of phase with one another so as to maintain uniform flexibility throughout the outsole over the major tread area, with the exception of the increased flexibility provided in the outsole by the transverse slots 50. The triangular teeth 108 in adjacent rows 106 may be provided with thin ridges 110 on one of their inclined faces 112 and 114. The staggered relationship of the teeth 108 provides small pockets at the base of the teeth which create a suction action when the teeth are deformed under load so as to increase the gripping action of the tread. To reduce friction, the teeth are not provided in the regions 100 and 102 of the tread, but rather shallow cross-bars are provided to reduce friction.

In FIGS. 5 and 6, a slightly different strut arrangement is shown in slots 50. While in the embodiment of FIGS. 2 to 4 three struts 54 are shown to bridge each slot at the top and each strut is flat at the bottom, the struts 116 in the embodiment of FIGS. 5 and 6 are round at the bottom and are staggered from one slot to another so that alternate slots contain three struts while the others contain two. This staggered relationship, while providing the increased strength at the ball section, somewhat increases the flexibility.

Having described this invention in detail, those skilled in the art will appreciate that numerous modifications that have been made in this invention without departing from its spirit. Therefore, it is not intended that the breadth of this invention be limited to the specific embodiments illustrated and described. Rather, the scope of the invention is to be determined by the appended claims and their equivalents.

What is claimed is:

1. A sole structure comprising:

a solid, rubber-like, one piece outsole having a first section of substantially uniform thickness from the heel and arch areas to the rear of the ball area of the sole structure, a second section of substantially uniform thickness from the front of the ball area to the tip of the toe area, and a third section of substantially uniform thickness disposed over the ball area of the structure, said first and second sections being appreciably thinner than the third section, and all these sections having bottom surfaces which are in a common plane, a wedge of cushion material adhered to the top of and conforming in plan view with the shape of the first section, said wedge being approximately equal in thickness at its rear portion to the difference in thickness between the first and third sections of the outsole and tapering to zero thickness at the front end of the wedge adjacent the third section, a midsole having a first section of rubber-like material of lesser density than the outsole and of uniform thickness, said midsole being adhered to the top of the wedge, said midsole being of uniform thickness and substantially equal to the difference in thickness of the first and third sections so that the upper surfaces of the midsole and third section of the outsole form a smooth, continuous surface, a second midsole section of the same material as the first midsole section and adhered to the top of the second section of the outsole, said second midsole section conforming in plan view to the rear portion of the second section of the outsole and being equal in thickness at its rear edge adjacent the third section to the difference in thickness of the second and third sections of the outsole and diminishing in thickness gradually to zero at the front edge so that its upper surface merges smoothly from the top surface of the third section to the top surface of the outsole second section, a plurality of parallel transverse slots across the third section of the outsole and extending upwardly from the bottom surface of the outsole and terminating just short of the top surface of the third section to enable the sole structure to bend readily under the ball area, and a tread array of longitudinal rows of saw-tooth cleats formed in the lower surface of the outsole and extending from the heel to the toe areas, said teeth in adjacent rows being out of phase with one another.

2. An article of footwear comprising:

a rubber outsole extending from the toe to the heel and having a section extending the full width of the sole structure and positioned to underlie the ball of the foot, a plurality of parallel slots traversing the section across the full width of the outsole and extending upwardly from the bottom surface to just short of the top surface thereof to form hinges in the outsole to make the section very flexible so that it can bend easily, a tread formed in the bottom surface of the outsole to provide increased traction for the sole structure on a surface, and a plurality of additional transverse slots provided in the section of the outsole and extending from the upper surface of said section downwardly toward the lower surface, said additional slots lying between the parallel transverse slots that form the hinges.

3. A sole structure as defined in claim 2 further characterized by said tread comprising an array of longitudinal rows of saw-tooth cleats formed in the lower surface of the outsole and extending from the heel to the toe areas, said teeth in adjacent rows being out of phase with one another.

4. A sole structure as defined in claim 2 further characterized by said tread including a plurality of spaced parallel ribs in the lower surface of the outsole, which ribs traverse the sole structure from the inner to the outer edge thereof to provide traction for the shoe into which the sole structure is incorporated.

5. A sole structure as defined in claim 2 further characterized by a midsole molded of a foam material covering portions of the bottom layer to the rear and forward of the section of the outsole to provide a cushion in the sole structure.

6. A sole structure as defined in claim 5 further characterized by said midsole tapering in thickness in a forward direction.

7. The sole structure as defined in claim 2 wherein said ball area section extends over approximately $\frac{1}{4}$ to 1/5 the total length of said outsole.

8. The sole structure as defined in claim 2 wherein said secondary slots terminate short of the side edges of said outsole.

9. A sole structure comprising:

a solid, rubber-like, one piece outsole having a first section of substantially uniform thickness from the heel and arch areas to the rear of the ball area of the sole structure, a second section of substantially uniform thickness from the front of the ball area to the tip of the toe area, and a third section of substantially uniform thickness disposed over the ball area of the structure, said first and second sections being appreciably thinner than the third section, and all these sections having bottom surfaces which are in a common plane, a plurality of parallel transverse slots across the third section of the outsole and extending upwardly from the bottom surface of the outsole and terminating just short of the top surface of the third section to enable the sole structure to bend readily under the ball area, and a plurality of struts bridging the slots at the upper ends thereof and secured as an integral part thereof to the margins of the slots in the third section to reinforce the sole structure when it is flexed along the slots.

10. A sole structure for athletic footwear comprising:

a rubber outsole extending from the toe to the heel and having a thickened section extending the full width of the sole structure and positioned to underlie the ball of the foot, said section being appreciably thicker than the remainder of the outsole, a plurality of parallel slots traversing the thicker section across the full width of the outsole and extending upwardly from the bottom surface to just short of the top surface thereof to form hinges in the outsole to make the thickened section very flexible so that it can bend easily, a tread formed in the bottom surface of the outsole to provide increased traction for the sole structure on a surface, and a plurality of struts bridging the slots at the upper ends thereof and secured as an integral part thereof to the margins of the slots in the thickened section to reinforce the sole structure when it is flexed along the slots.

11. A running shoe comprising:

a rubber outsole extending from the toe to the heel and having a thickened section extending the full width of the sole structure and positioned to underlie the ball of the foot, said section being appreciably thicker than the remainder of the outsole, a plurality of parallel slots traversing the thickened section across the full width of the outsole and extending upwardly from the bottom surface to just short of the top surface thereof to form hinges in the outsole to make the thickened section very flexible so that it can bend easily, a tread formed in the bottom surface of the outsole to provide increased traction for the sole structure on a surface, a midsole molded of a foam material covering portions of the bottom layer to the rear and forward of the thickened section of the outsole, respectively, to provide a cushion in the sole structure, said midsole tapering in thickness in a forward direction, and a plurality of struts bridging the slots at the upper ends thereof and secured as an integral part thereof to the margins of the slots in the thickened section to reinforce the sole structure when it is flexed along the slots.

12. A running shoe as defined in claim 11 further characterized by said tread structure comprising a plurality of spaced ribs parallel to the slots and which traverse the outsole.

13. An athletic shoe as defined in claim 11 further characterized by said tread structure comprising an array of longitudinal rows of saw-tooth cleats on the lower surface of the outsole and extending from the heel to the toe, said teeth in adjacent rows being out of phase with one another.

14. A sole structure for athletic footwear comprising:

a rubber outsole extending from the toe to the heel and having a thickened section extending the full width of the sole structure and positioned to underlie the ball of the foot, said section being appreciably thicker than the remainder of the outsole, a plurality of parallel slots traversing the thicker section across the full width of the outsole and extending upwardly from the bottom surface to just short of the top surface thereof to form hinges in the outsole to make the thickened section very flexible so that it can bend easily, a tread formed in the bottom surface of the outsole to provide increased traction for the sole structure on a surface, and a plurality of additional transverse slots provided in the thickened section of the outsole and extending from the upper surface of said section downwardly toward the lower surface, said additional slots lying between the parallel transverse slots that form the hinges.

15. A sole structure comprising:

solid, rubber-like, one piece outsole having a first section of substantially uniform thickness from the heel and arch areas to the rear of the ball area of the sole structure, a second section of substantially uniform thickness from the front of the ball area to the tip of the toe area, and a third section of substantially uniform thickness disposed over the ball area of the structure, said third section extending over approximately $\frac{1}{4}$ to 1/5 the total length of the outsole and being appreciably thicker than said first and second sections to provide a long-wearing cushioning portion beneath the ball of the foot, a plurality of primary parallel transverse slots across the third section of the outsole and extending upwardly from the bottom surface of the outsole and terminating just short of the top surface of the third section to enable the sole structure to bend readily under the ball area, and a plurality of secondary transverse slots provided in said third section of said outsole and extending from the top planar surface of said third section downwardly toward the bottom surface, said secondary slots lying between said primary slots.

16. A sole structure as defined in claim 15 wherein said secondary slots terminate short of the side edges of said outsole.

17. A running shoe comprising:

a rubber outsole extending from the toe to the heel and having a section extending the full width of the sole structure and positioned to underlie the ball of the foot, a plurality of parallel slots traversing the section across the full width of the outsole and extending upwardly from the bottom surface to just short of the top surface thereof to form hinges in the outsole to make the section very flexible so that it can bend easily, a tread formed in the bottom surface of the outsole to provide increased traction for the sole structure on a surface, and a plurality of struts bridging the slots at the upper ends thereof and secured as an integral part thereof to the margins of the slots in the section to reinforce the sole structure when it is flexed along the slots.

18. An article of footwear comprising:

a rubber outsole extending from the toe to the heel and having a section extending the full width of the sole structure and positioned to underlie the ball of the foot, a plurality of parallel slots traversing the section across the full width of the outsole and extending upwardly from the bottom surface to just short of the top surface thereof to form hinges in the outsole to make the section very flexible so that it can bend easily, and a plurality of additional transverse slots provided in the section of the outsole and extending from the upper surface of said section downwardly toward the lower surface, said additional slots lying between the parallel transverse slots that form the hinges.

19. In combination with the sole structure of claim 18, a flexible shoe upper secured to the sole structure and togther forming a running shoe.

* * * * *